US011639247B2

(12) United States Patent
Burden

(10) Patent No.: US 11,639,247 B2
(45) Date of Patent: May 2, 2023

(54) DUAL CHAMBERED CANTEEN WITH INTERCHANGEABLE SPOUTS

(71) Applicant: Gwendolyn D Burden, Pearland, TX (US)

(72) Inventor: Gwendolyn D Burden, Pearland, TX (US)

( * ) Notice: Subject to any disclaimer, the term of this patent is extended or adjusted under 35 U.S.C. 154(b) by 0 days.

(21) Appl. No.: 16/805,268

(22) Filed: Feb. 28, 2020

(65) Prior Publication Data

US 2021/0269195 A1 Sep. 2, 2021

Related U.S. Application Data

(63) Continuation of application No. 15/064,822, filed on Mar. 9, 2016, now abandoned.

(51) Int. Cl.
*B65D 25/04* (2006.01)
*A45F 3/18* (2006.01)
(Continued)

(52) U.S. Cl.
CPC ..... *B65D 25/04* (2013.01); *A45F 3/18* (2013.01); *A47G 19/2266* (2013.01); *B65D 47/127* (2013.01); *B65D 2547/063* (2013.01)

(58) Field of Classification Search
CPC ..... B65D 25/04; B65D 47/127; B65D 2547/063; B65D 81/3283; B65D 47/065;
(Continued)

(56) References Cited

U.S. PATENT DOCUMENTS 2,197,672 A * 4/1940 Winters ..... B65D 47/305 222/490
5,223,245 A * 6/1993 Ibrahim ..... A61K 8/02 206/568

(Continued)

*Primary Examiner* — Shawn M Braden
(74) *Attorney, Agent, or Firm* — Delphine James

(57) ABSTRACT

A beverage canteen container of various materials but not limited to plastic, stainless steel, glass etc. having at least two manufactured compartments separated by a non removable partition wall which features a sleek contour body canteen design and allows the canteen container to hold two separate liquids, pureed or solid food in the canteen. The interchangeable canteen lid will have two interchangeable flip-up Y-spout designs. The first flip-up Y-spout design will allow two products to be extracted from both chambers of the canteen bottom and blend together when extracted through the single elongated tube end into the mouth. The second flip-up Split Y-spout design is split through the end of the Y, resulting in two individual elongated tubes and will provide individual product extraction. Both the Y-spout or the Split Y-spout can be attached and reattached to the top of the canteen lid by two pivotal balls with axles on opposite side of the balls. The axles also secures the spout to the top of the lid's base for opening and closing the spout. There are O-rings located around the non-removable base opening of the canteen lid and will be underneath the pivotal balls. The O-rings will seal the opening when the spouts are in an opened position for an airtight seal between the spouts and the chambers. There are vent release plugs located underneath both the Y-spout and the Split Y-spout to plug the atmosphere vent release holes located on top of the lid when the spouts are in the closed position and will provide an airtight seal when in the closed position. The canteen lid is designed to snap tightly and securely seal by an inverted J shaped peripheral section around the edge of the lid for latching and locking in an airtight position without needing a gasket, so there is no gasket for this design! There lid has two separate non-removable inner wall compartments on the underside that fits inside each chamber of the canteen
(Continued)

container bottom with the means of ensuring proper positioning of the lid over each compartment and will assist in preventing the mixing of products from either chamber and will provide an airtight seal for each chamber. Also, the separate inner walls located underneath the lids are ingenious for ensuring that the lid will easily fit the top of each chamber while providing an extra step in ensuring separating the chambers for liquids, puree or solid foods. There are (optional) straw inserts attachment constructed underneath the lid and can be used for sipping purposes. The canteen can be turned upward for a chug a lug product extraction experience.

10 Claims, 8 Drawing Sheets

(51) Int. Cl.
*B65D 47/12* (2006.01)
*A47G 19/22* (2006.01)

(58) Field of Classification Search
CPC ..... B65D 1/04; A45F 3/18; A47G 19/2266; A47G 2019/122
See application file for complete search history.

(56) References Cited

U.S. PATENT DOCUMENTS

| | | | | |
|---|---|---|---|---|
| 6,439,433 | B1 * | 8/2002 | Dubach | B65D 47/06 222/481.5 |
| 7,975,868 | B1 * | 7/2011 | Flies | B65D 1/265 220/524 |
| 8,844,316 | B1 * | 9/2014 | Ademola | F25D 3/08 62/457.3 |
| 10,974,881 | B1 * | 4/2021 | Ashton | B65D 25/04 |
| 2006/0024996 | A1 * | 2/2006 | Johnson | H02G 3/00 439/215 |
| 2006/0151496 | A1 * | 7/2006 | Healy | A47G 21/18 220/23.83 |
| 2009/0065503 | A1 * | 3/2009 | Hertzig | A47G 21/18 220/4.24 |
| 2014/0048511 | A1 * | 2/2014 | El-Saden | A47G 19/2266 215/389 |
| 2015/0353259 | A1 * | 12/2015 | Burden | B65D 81/3283 222/145.1 |
| 2016/0200474 | A1 * | 7/2016 | Burden | A47G 19/2266 222/144.5 |

* cited by examiner

Bottom View

DUAL CHAMBERED CANTEEN WITH INTERCHANGEABLE SPOUTS

FIELD OF INVENTION

The present invention to an improved liquid, puree and solid container. More specifically, it is a dual-chambered sleek canteen shaped beverage designed container (while others or most are round) that can be manufactured with but not limited to using materials such as plastic, stainless steel, glass, foam etc. for dispensing fluid and semi-fluid products from associated chambers while maintaining a secured tight seal over the mouth of both chambers with two separated non-removable inner wall compartments designed underneath the lid for easy lid positioning onto the canteen container, two release hole vents are constructed in the top of the lid and over each chamber for atmosphere release when products are dispersed, no gasket is needed because of the inner wall compartments and O-rings over the opening of the lid base that secure a tight seal of the container bottom and lid. There are two flip-up spout designs, a Y-spout and a Split Y-spout. The Y-spout has two elongated tubes that come together to form one elongated tube for extracting two products from the dual container chambers and will mix together when contents reach the single end opening to the mouth. The Split Y-spout is separated through the middle, resulting in two individual elongated tubes for separate and individual product extraction. When either Y-design spout is flipped up the aperture at the base of the pivotal ball align with the opening in the non-removable lid base for products to disperse. The pivotal balls have axles attached to each side and are used to secure the Y-spouts securely to the lid. Two release holes plugs are constructed underneath the spout designs to seal off the atmosphere vents and provide an airtight seal when the spouts are in the closed position and over the opening of each chamber.

BACKGROUND OF THE INVENTION

Beverage containers with the separate and distinct compartments are unusual, but not unheard of in the marketplace. It has been proposed in the art to provide similar or dissimilar liquid products within the same chambers of a single container. The compartments are typically divided by a vertical partition that will extend from the bottom of container to the mouth opening of each compartment to ensure the products does not comingle. Most dual-chambered liquid containers on the market today has provided a means for sealing off each compartment to prevent spillage by either a separate cap or lid that fit over each mouth opening or a single cap to cover or seal all mouth with either a snap or the traditional screw on method. The problem that exists is the failure to create a reliable secure tight seal to prevent spillage, or the mouth opening may be inadvertently aligned over the partitions or between the compartments. Finally, two separate manufactured molded non-removable inner wall compartments that fits inside each chamber has afforded this design the secured fit necessary for airtightness needed. Therefore, there is a need for a dual—chambered liquid, puree or solid food container that includes features that would allow an easy to use lid with its specially designed components that would reliably secure and provide an airtight seal to each container compartment openings without having to use gaskets when the lid is closed. Furthermore, the idea for the invention development is to provide a method of manufacturing a dual-chambered lid of the type described with the option of using different materials for production purposes and a method of dispensing two products from two separate compartments and these two products mixing together or individually when extraction takes place.

SUMMARY OF INVENTION

The dual-chambered canteen of the present invention includes a dual-chambered container with a non removable vertical partition wall separating each chamber, a lid with two separate non-removable inner wall compartments that fits inside each chamber of the canteen container and securely separate the liquids while ensuring proper positioning and an airtight seal of the lid over each compartment without having to use gaskets. The lid has release holes for venting the container chambers to atmosphere for continuous liquid flow from the canteen container. The lid is constructed and or designed with two openings in the non-removal base that aligned over the chambers and has two O-rings one around each opening for a secure fit for both the Flip-up Y-spout and Flip-up Split Y-spout and to ensure an airtight seal. The interchangeable flip-up spouts has an aperture designed in the pivotal balls construction base of each spout and the balls is secured in place to the lid base by snap fit axles attached to the outer sides of each ball. Two vent hole plugs are constructed underneath the flip-up spouts and the plugs are design to provide a seal for the vent hole located in the top of the lids when the spout is in the closed position. The inside of the spouts elongated tubes has aperture holes for even flow when liquids are extracted. There are constructed insert outlets underneath the lid and base that will provide (optional) straws insertion for sipping purposes. Otherwise, products can be extracted when container is in an upward position. The two interchangeable innovative flip-up spouts, will provide the extraction of products from both chambers of the canteen container through the Y end of the spout and mix together using the Y-design spout or individual consumption using the split Y-design spout through the single end of the spout before reaching the mouth.

BRIEF DESCRIPTION OF THE DRAWINGS

The invention with features, advantages and additional parts will apparent and best understood from the following detailed description in conjunction with the drawings in which.

DETAIL DESCRIPTION

Figure 1:
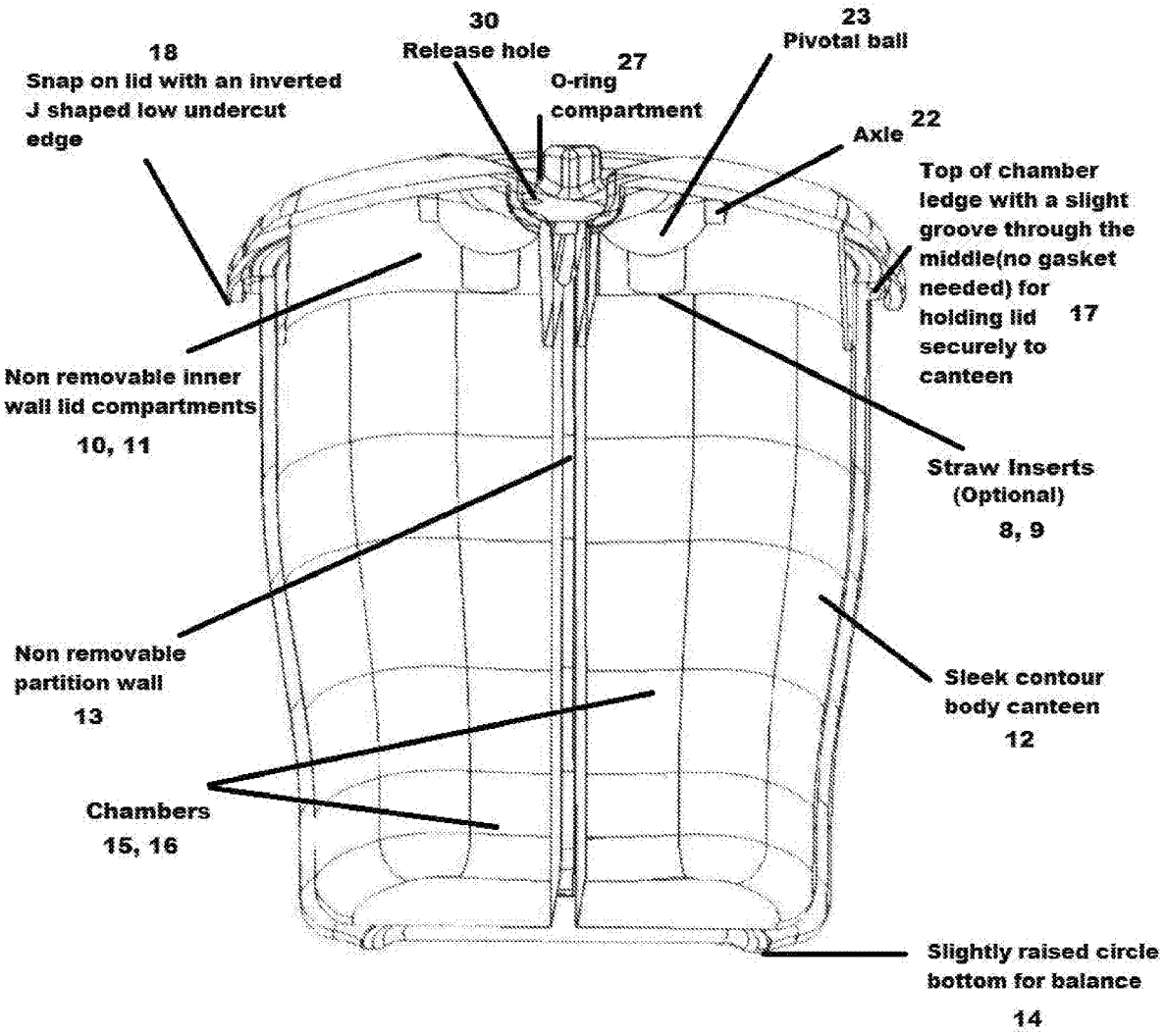
FIG. 1 is a cross section view of the dual chambered canteen container constructed in accordance with the invention.
Figure 2:
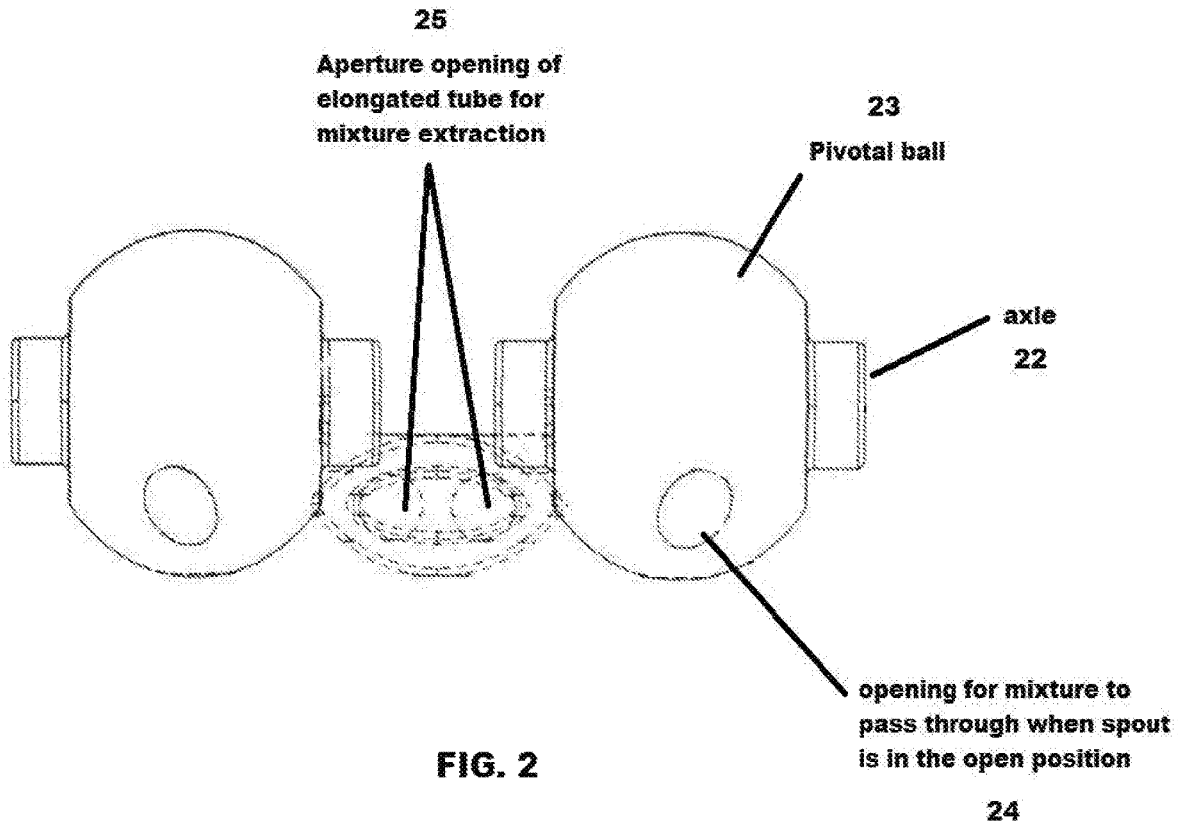
FIG. 2 is a cross section view of the flip-up spout constructed in accordance with the invention.
Figure 3:
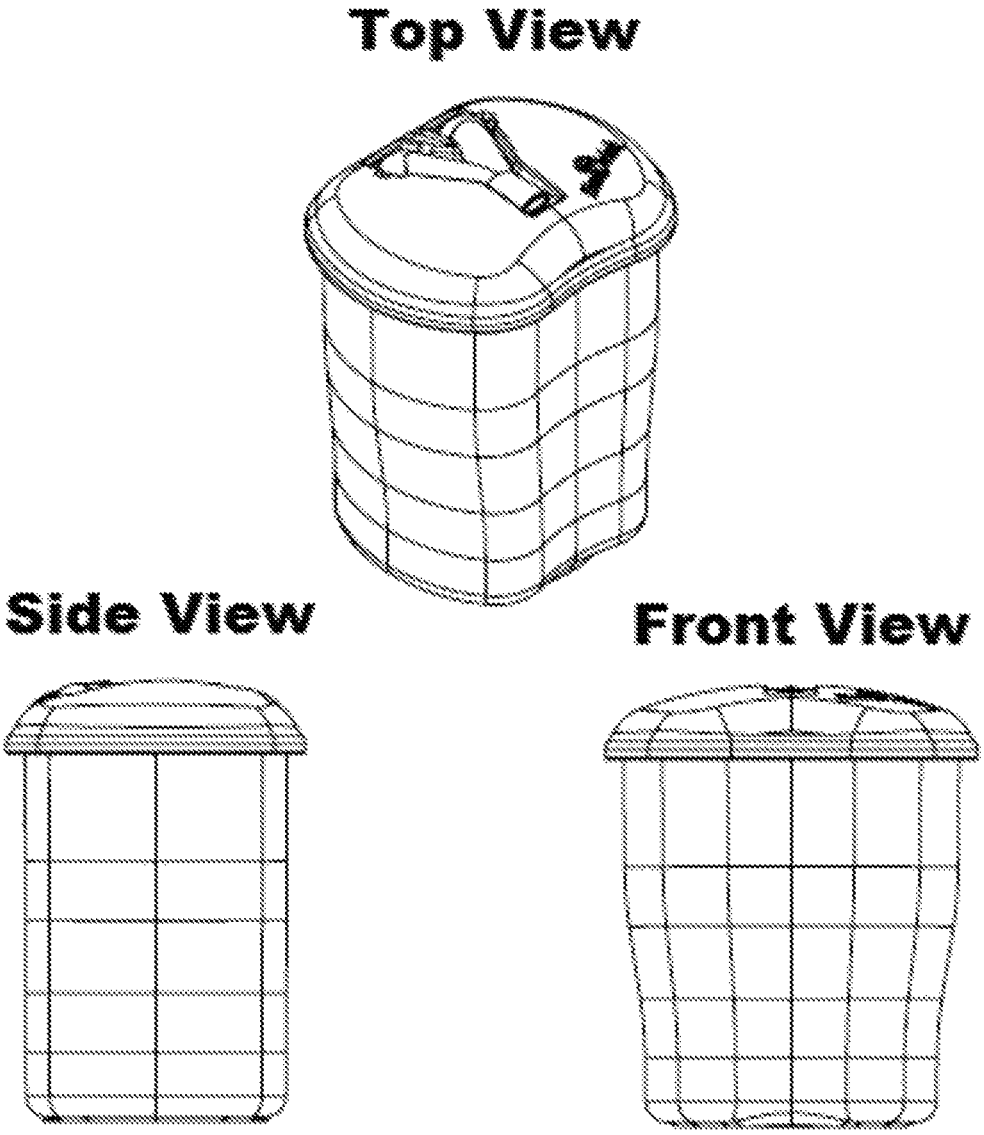
FIG. 3 is a top, side and front view of the sleek contour design dual chambered canteen container.
Figure 4:
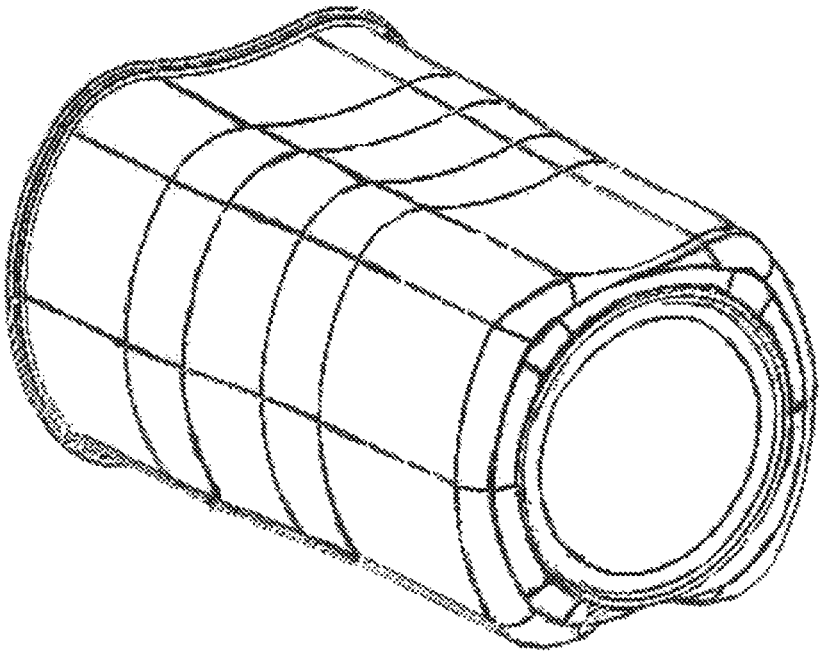
FIG. 4 is the bottom view of the canteen container
Figure 5:
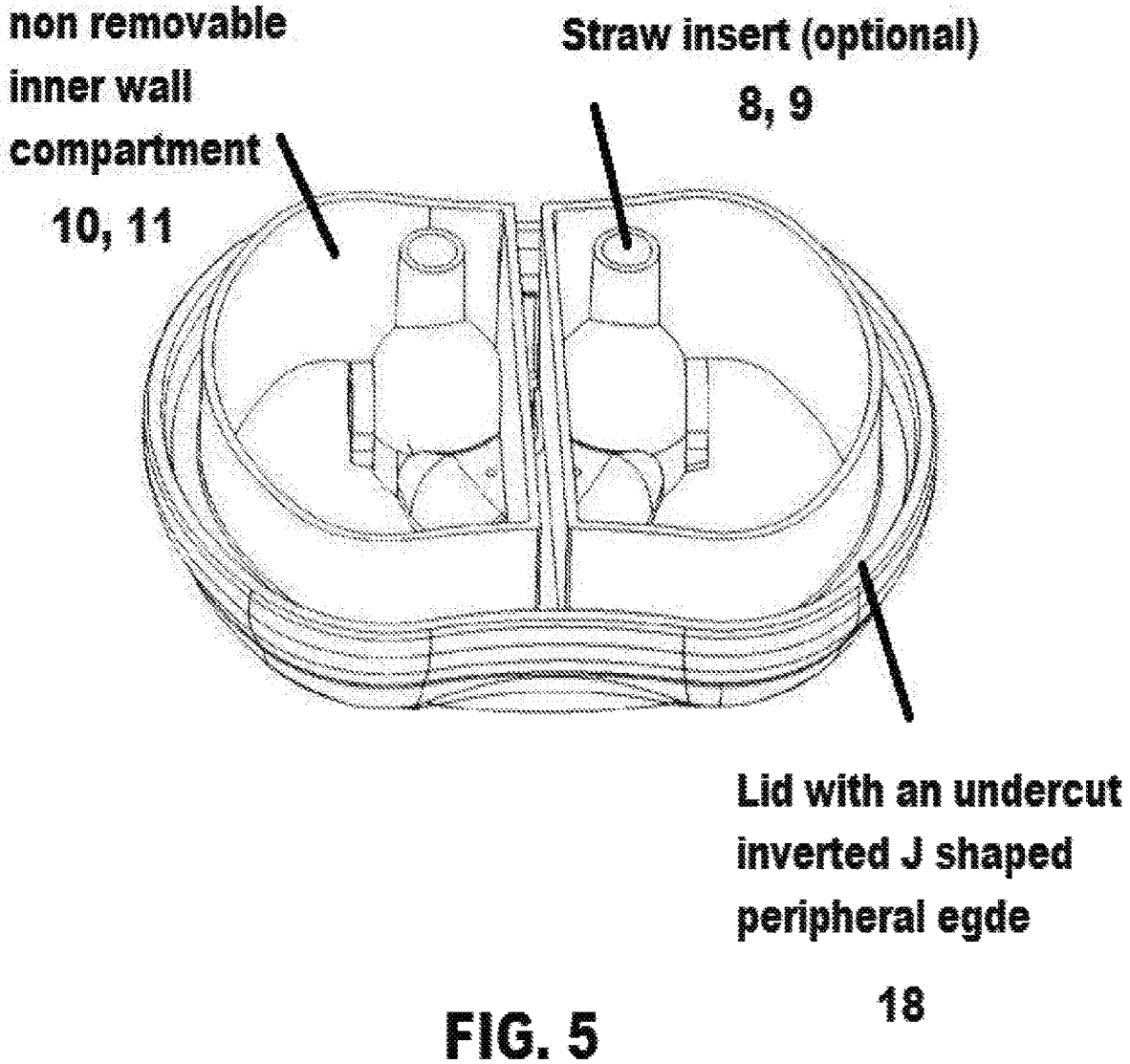
FIG. 5 is a bottom view of the lid and shows the peripheral inverted j edge for latching, the inner wall compartments and short elongated tubes outlets for adding straws which is optional. The straws would work in co-conjunction with the spouts for product extraction.

Initially referring to FIG. 1-8 where like numerals indicate like and corresponding elements, a dual-chambered beverage canteen container. The canteen container 12 (FIG. 1) is a sleek contour design that has a broad shoulder contour at the top with a slight narrowing contour toward the base and 14*xx* (FIG. 4) is a circular slightly raised stand in the center underneath the container for assisting with the leveling of the container on flat surfaces with two chamber compartments 15, 16 (FIG. 1) divided by a vertical partition 13 (FIG. 1). The vertical partition 13 (FIG. 1) is irremovably coupled to the container and the same height as the container's ledge rim 17 (FIG. 1). The interchangeable lid will snap tightly and securely with an inverted J shaped peripheral section around the edge of the lid 18 (FIG. 1) for latching and holding the lid in place.

A first lid member includes an interchangeable flip-up Y-spout design 20 (FIG. 7) that attaches to a non-removable base 21 (FIG. 6) by pivotal balls 23 and with axles 22 (FIG. 7) on each side of the balls. The balls 23 (FIG. 7) have an aperture 24 (FIG. 2) located on the back of each pivotal ball 23 (FIG. 7) and two aperture 25 (FIG. 2) constructed on the inside of the elongated tube spout for liquid or puree foods extraction from the single end of the elongated tube spout 26 (FIG. 7). The balls 23 (FIG. 7) are positioned over the O-rings 27 (FIG. 1) and the non-removable base openings 28 and 29 (FIG. 6) of the canteen lid and first and second chamber 15 and 16 (FIG. 1). Two non-removable inner wall compartments 10 and 11 (FIG. 1) are located underneath the lid and fit inside each canteen container chamber 15, 16 (FIG. 1) to ensure secure lid positioning and aid in product separation. Straw attachment outlets for optional straw insertion 8 and 9 (FIG. 1)

Figure 6:
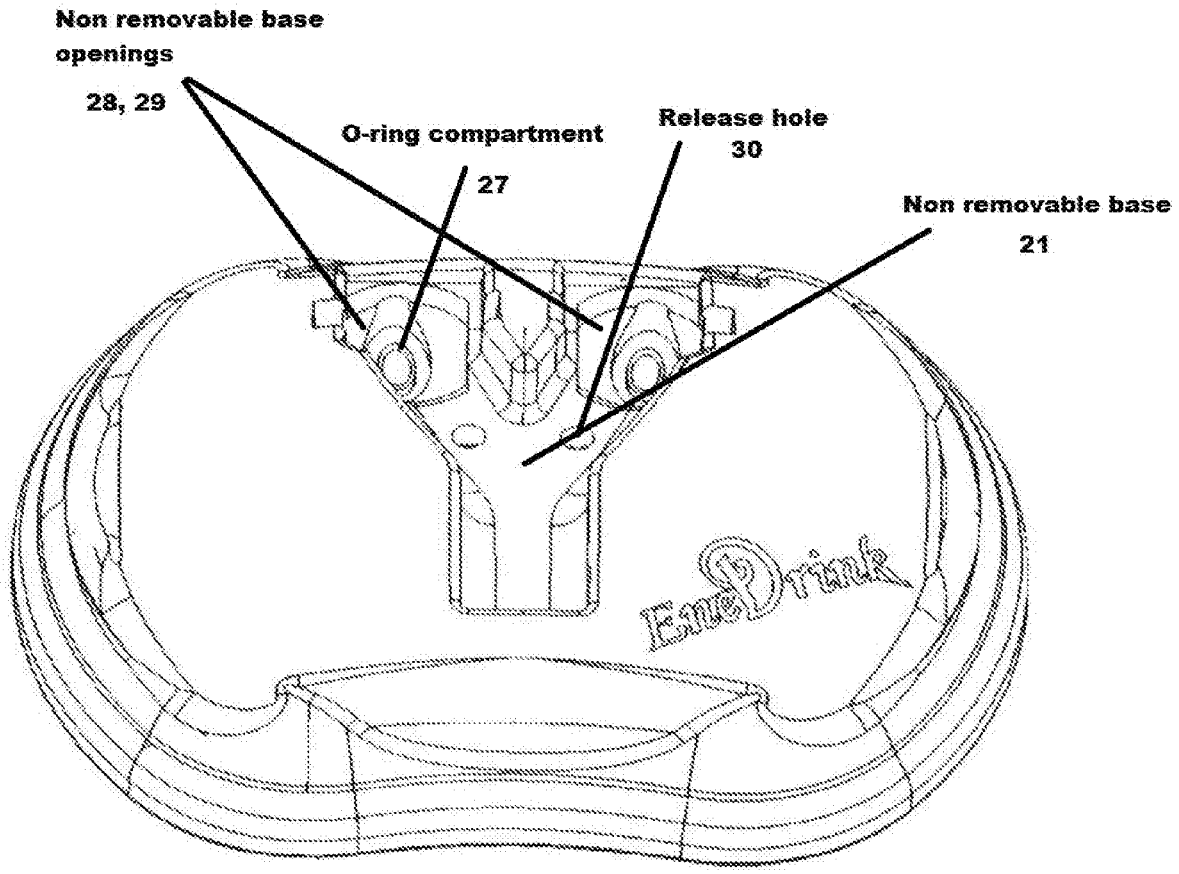
FIG. 6 is a top view of the lid and the O-ring placement and the release holes.
Figure 7:
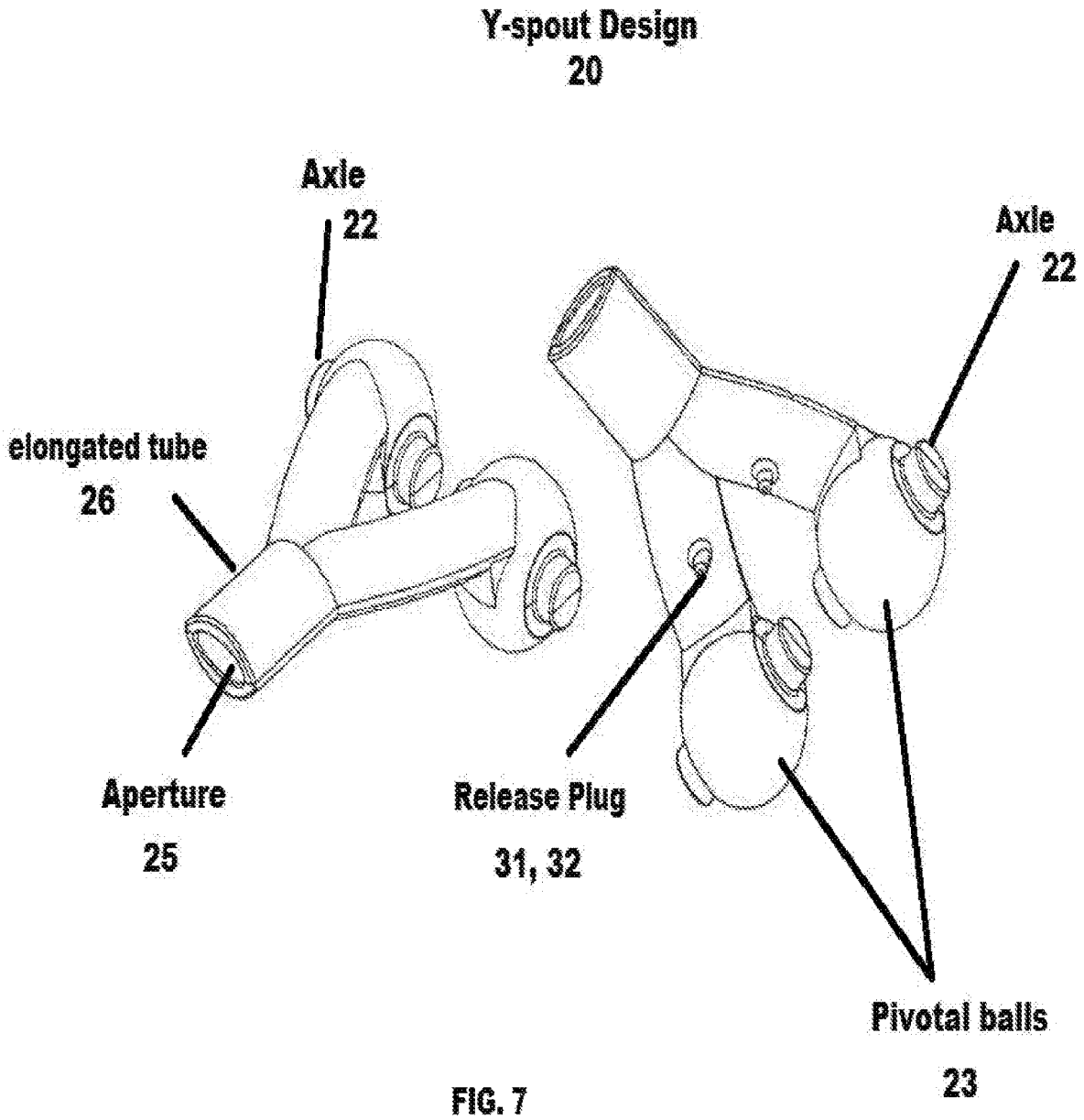
FIG. 7 is a top view And bottom view of the Flip-up Y-design Spouts, showing the release plug, axle and elongated tube.
Figure 8:
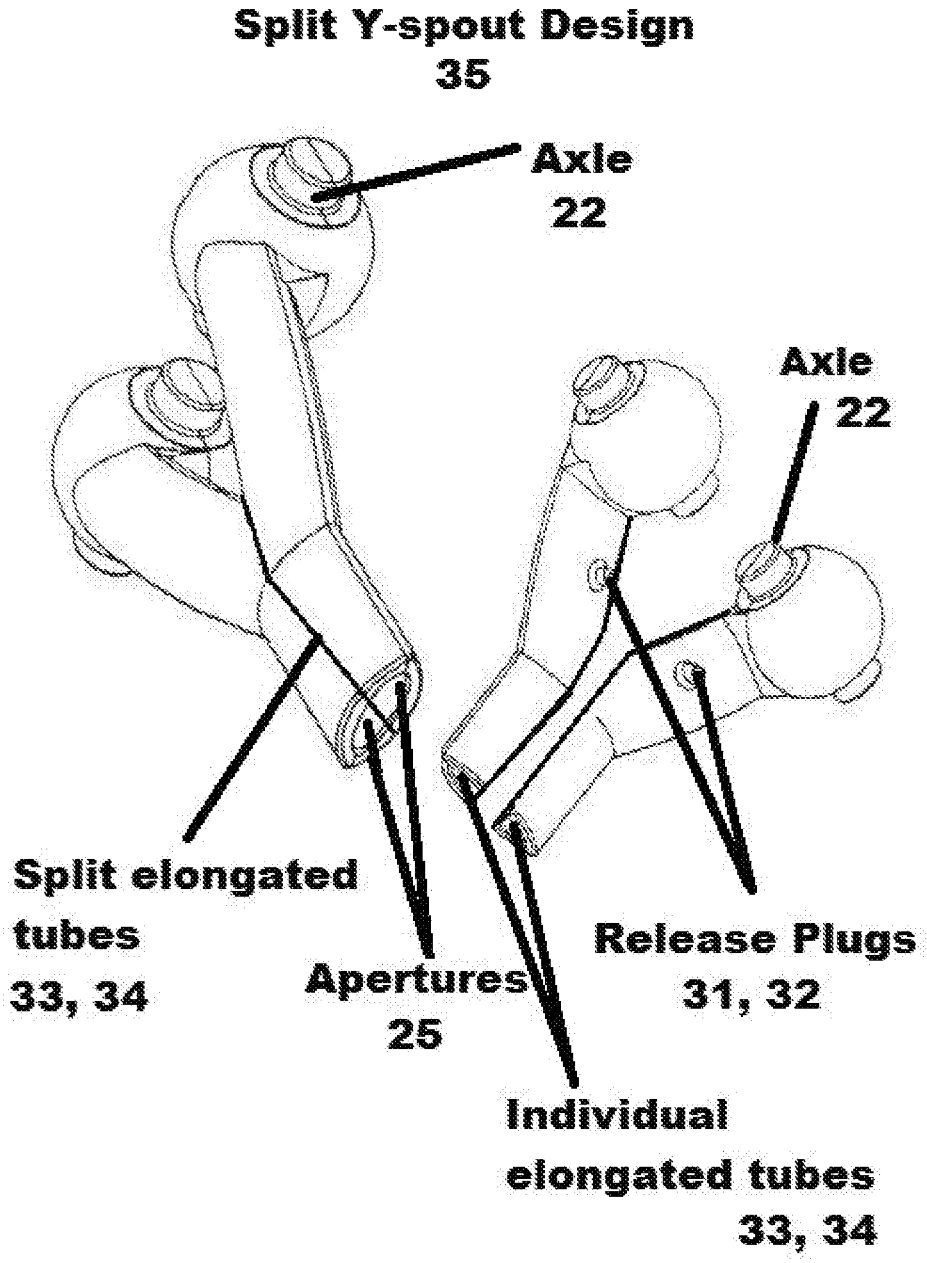
FIG. 8 is a top view, side view and bottom view of the Flip-up Split Y-design Spout, showing the release hole, pivotal ball and split individual elongated tubes.

A second lid member includes an interchangeable flip-up Split Y-design (FIG. 35) which allows Individual spout usage 33, 34 (FIG. 8) with pivotal balls 23 and axles 22 (FIG. 8) on the sides of the ball that attaches to the non-removable base 21 (FIG. 6). The balls have an aperture 25 (FIG. 8) located on the back of each pivotal ball 23 (FIG. 8) and have two separate aperture 25 (FIG. 8) located inside of the elongated tube spouts 33, 34 (FIG. 8) for liquid or puree foods extraction. The pivotal balls 23 (FIG. 8) are positioned over the O-ring compartments 27 (FIG. 6) and the first non-removable base opening 28 and the second opening 29 (FIG. 6). Two non-removable inner wall compartments 10, 11 (FIG. 1) are located underneath the lid and fit inside each container chamber 15, 16 (FIG. 1) to ensure lid positioning and aid in product separation. Straw attachment outlets for optional straw insertion 8 and 9 (FIG. 1) An atmosphere release vent holes 30 (FIG. 1) and release hole plugs 31, 32 (FIG. 7 & FIG. 8) are designed for liquid flow when flip-up spouts are in use and secure an airtight secure seal when in the closed position. Though it is intended to fully describe the invention as set forth, it is also reasonable to assume that one skilled in the art could modify, adjust or adapt certain parts of this dual-chambered canteen container without departing from its original scope. The implementation of an individual or even a combined improvement as part of another dual-chambered canteen container is possible. For example, adding more compartments would be well within the bounds of what has been presented here. Other configurations such as a vertical partition, insulated materials for thermal conductivity between compartments or the container. Various known configurations could be used to partition two or more liquids or puree foods with a single container or other features could be added to the lid opening.

The defining features of this improved dual-chambered canteen container is that in addition to easy positioning and proving a non-gasket seal to achieve a secured and airtight snap on lid, the configuration is such that the opening to flip-up spouts and each chamber will be consistently positioned in a fixed configuration whether in the open or closed position and when opened will provide a dual separation to single mixing or an individual separation mixing experience.

The recommended materials are but not limited to plastic, stainless steel, foam and glass. Other modifications will readily suggest themselves to others of ordinary skills in the art without departing in any way from the spirit of the present invention. The invention is merely intended to embrace all such alternatives and modifications or configurations as fall within the broad scope of the appended claims.

What is claimed is:

1. A canteen beverage container comprising:

the container having a body member with a pair of opposing dual chambers separated by a non-removable partition that extends vertically from an opened top end to a lower end;

the container being non-removable;

the lower end being seated upon a contiguous base;

a rim formed at the opened top end by the pair of opposing dual chambers;

each of the pair of opposing dual-chambers having a symmetrical shape;

each of the pair of opposing dual-chambers having a bottom wall with a surrounding wall extending linearly upward to the rim;

an interchangeable lid having a peripheral edge encircled by an inverted J shaped lip for securely engaging with the rim a top side and an underside;

a recessed area within the top side dimensioned and shaped to receive a Y shape spout;

the y shaped spout having a linear tubular member having a distal end merging into an apex point of a V shape tubular member;

the v shape tubular member having a pair of diverging tubular members with each extending to a pivot ball that is seated above a dual chamber;

on opposing sides of each pivot ball is a pivoting axle wherein the Y spout can pivot between an upward and a downward position;

and the surrounding wall having a top contour with a broader shoulder that narrows to a bottom contour that is disposed above the base.

2. The canteen beverage container of claim 1, wherein the base has a circular circumference.

3. The canteen beverage container of claim 1, wherein the base has a raised center portion thereby allowing the container to stand on flat surfaces.

4. The canteen beverage container of claim 1, wherein the linear tubular member of the Y Spout is permanently split to the apex point of the V shape tubular member.

5. The canteen beverage container of claim 4, wherein a first pair of release holes is attached to the underside of the lid into a second pair of corresponding release holes formed by the plug on each pivot ball of the thereby allowing an airtight seal when the Y shout is in a closed position.

6. The canteen beverage container of claim 1 wherein the lid further comprises an O rings circumferentially surround the underside of the peripheral edge of the lid.

7. The canteen beverage container of claim 1 wherein the lid further comprises one or more straw attachment outlet disposed above a corresponding dual chamber and extending through the lid thereby allowing fluid to flow from the corresponding dual chamber.

8. The canteen beverage container of claim 1 further comprising: a pair of atmosphere release plugs disposed underneath the pair of diverging tubular members;

a pair of corresponding atmosphere release vent holes for engaging with the pair of atmosphere release plugs within the lid thereby allowing liquid flow when the Y spout is in use and securing an airtight secure seal when in the y spout is in a closed position.

9. The canteen beverage container of claim 8, wherein a first pair of release holes is attached to the underside of the lid into a second pair of corresponding release holes formed by the plug on each pivot ball thereby allowing an airtight seal when the Y shout is in a closed position.

10. The canteen beverage container of claim 4 further comprising: a pair of atmosphere release plugs disposed underneath the pair of diverging tubular members;

a pair of corresponding atmosphere release vent holes for engaging with the pair of atmosphere release plugs within the lid thereby allowing liquid flow when the Y spout is in use and securing an airtight secure seal when in the y spout is in a closed position.

* * * * *